US010281854B2

(12) United States Patent
Oshima et al.

(10) Patent No.: US 10,281,854 B2
(45) Date of Patent: May 7, 2019

(54) IMAGE FORMING APPARATUS

(71) Applicant: CANON KABUSHIKI KAISHA, Tokyo (JP)

(72) Inventors: Kana Oshima, Ako (JP); Jiro Shirakata, Chigasaki (JP); Shusuke Miura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/254,881

(22) Filed: Sep. 1, 2016

(65) Prior Publication Data

US 2017/0068192 A1 Mar. 9, 2017

(30) Foreign Application Priority Data

Sep. 8, 2015 (JP) ..... 2015-176855

(51) Int. Cl.
*G03G 15/00* (2006.01)
*G03G 15/20* (2006.01)

(52) U.S. Cl.
CPC ..... *G03G 15/2039* (2013.01); *G03G 15/80* (2013.01); *G03G 2215/2035* (2013.01)

(58) Field of Classification Search
CPC ..... G03G 15/2039
See application file for complete search history.

(56) References Cited

U.S. PATENT DOCUMENTS

| | | | | |
|---|---|---|---|---|
| 7,349,642 | B2 | 3/2008 | Tatematsu | |
| 8,526,836 | B2 | 9/2013 | Mitsuoka | |
| 2010/0061754 | A1* | 3/2010 | Ishigaya | G03G 15/5004 399/70 |
| 2011/0142472 | A1* | 6/2011 | Mitsuoka | G03G 15/2039 399/69 |
| 2011/0293309 | A1* | 12/2011 | Hase | G03G 15/2039 399/69 |

FOREIGN PATENT DOCUMENTS

JP 2007-241155 A 9/2007

* cited by examiner

*Primary Examiner* — Noam Reisner
(74) *Attorney, Agent, or Firm* — Canon U.S.A., Inc. IP Division

(57) ABSTRACT

An image forming apparatus includes an image forming unit, a fixing unit having a heating member for generating heat based on power supplied, a detection unit, and a controller. The image forming unit forms an image on a sheet. The fixing unit fixes the image on the sheet by the heat of the heating member. The detection unit detects a temperature of the heating member. The controller controls power to be supplied to the heating member based on a temperature detected by the detection unit. The controller determines a difference value between the temperature detected by the detection unit and a target temperature, determines an accumulated value by performing accumulation processing of the difference value, and controls the power based on the difference value and the accumulated value. The controller controls the accumulation processing based on the difference value and the accumulated value.

14 Claims, 7 Drawing Sheets

IMAGE FORMING APPARATUS

BACKGROUND OF THE INVENTION

Field of the Invention

Embodiments of the present invention relate to power control of a heating member included in a fixing unit.

Description of the Related Art

An electrophotographic method image forming apparatus forms an image on a sheet using toner, melts the toner by heat generated by a heating member installed in a fixing unit, and fixes the image on the sheet. The fixing unit is provided with a sensor for detecting a temperature of the heating member, and power supplied to the heating member is controlled so that the temperature of the heating member detected by the sensor will be a target temperature.

For example, an image forming apparatus described in Japanese Patent Application Laid-Open No. 2007-241155 controls power supplied to a heating member based on a difference value between a target temperature and a temperature of the heating member and an accumulated value of the difference values between the target temperature and the temperature of the heating member so as to control the power supplied to the heating member. The image forming apparatus uses a different operation coefficient according to an operation mode. According to the image forming apparatus described in Japanese Patent Application Laid-Open No. 2007-241155, an operation coefficient used in a period from when power is supplied to the heating member to when a temperature of a heater reaches a printable temperature and an operation coefficient used in printing are different. Embodiments of the present invention are directed to control of power supplied to a heating member with high accuracy.

SUMMARY OF THE INVENTION

According to an aspect of the present invention, an image forming apparatus includes an image forming unit configured to form an image on a sheet, a fixing unit having a heating member for generating heat based on power supplied, and configured to fix the image on the sheet by the heat of the heating member, a detection unit configured to detect a temperature of the heating member, and a controller configured to control power to be supplied to the heating member based on a temperature detected by the detection unit, wherein the controller determines a difference value between the temperature detected by the detection unit and a target temperature, determines an accumulated value by performing accumulation processing of the difference value, and controls the power based on the difference value and the accumulated value, and wherein the controller controls the accumulation processing based on the difference value and the accumulated value.

Further features of the present invention will become apparent from the following description of exemplary embodiments with reference to the attached drawings.

DESCRIPTION OF THE EMBODIMENTS (Description of Image Forming Apparatus)

Figure 1:
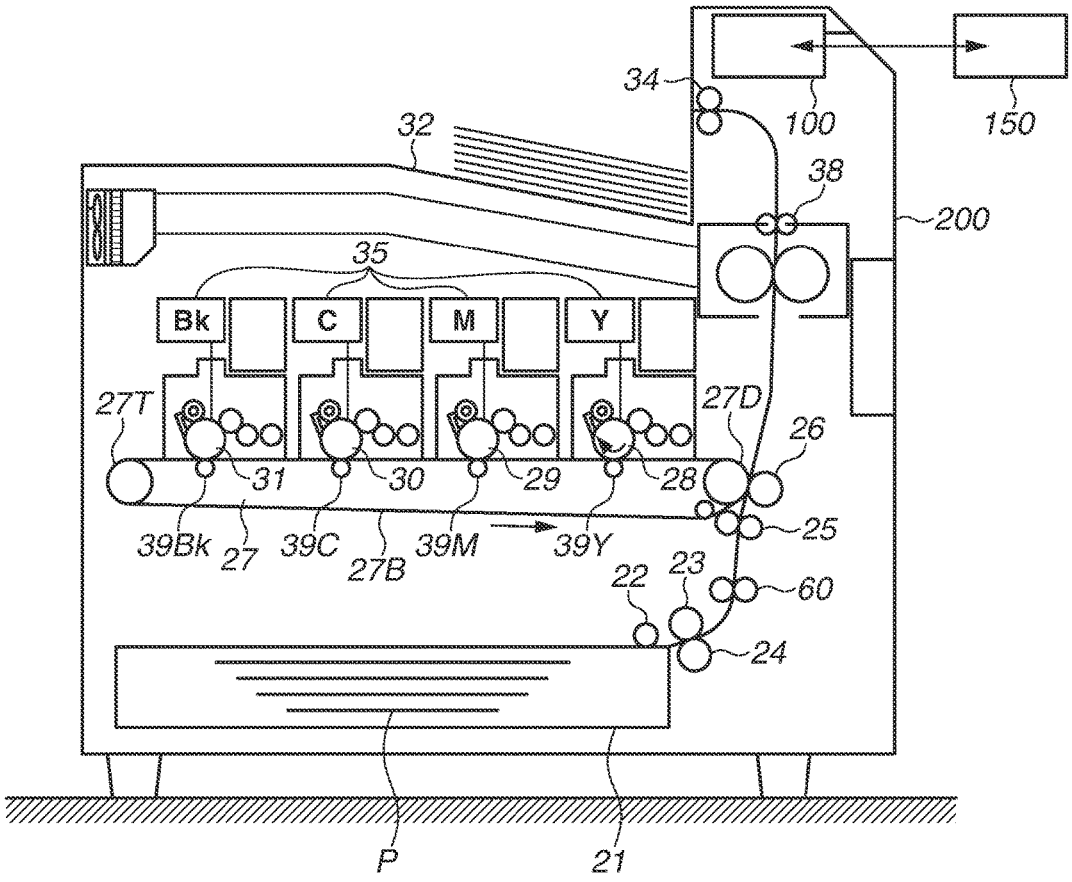
FIG. 1 is a schematic cross-sectional view of an image forming apparatus.

FIG. 1 is a schematic cross-sectional view of an image forming apparatus. Each unit in the image forming apparatus is controlled by a control unit 100. The control unit 100 of the image forming apparatus is connected to an external host apparatus 150 such as a personal computer (PC) and a scanner via a communication line. The image forming apparatus forms an image on a sheet based on image data input from the external host apparatus 150.

The image forming apparatus includes a plurality of image forming units 28, 29, 30, and 31, an intermediate transfer unit 27, a sheet feeding cassette 21, and a fixing unit 200. The image forming unit 28 uses a yellow toner to form an image. The image forming unit 29 uses a magenta toner to form an image. The image forming unit 30 uses a cyan toner to form an image. The image forming unit 31 uses a black toner to form an image. The intermediate transfer unit 27 includes an intermediate transfer belt 27B, a driving roller 27D, and a tension roller 27T. The intermediate transfer belt 27B is wound around the driving roller 27D and the tension roller 27T. The driving roller 27D rotates, and the intermediate transfer belt 27B is rotated in a counterclockwise direction in FIG. 1.

The image forming unit 28 includes a photosensitive drum in which a photosensitive layer is provided on a surface of an aluminum cylinder. The photosensitive drum is driven to rotate by a motor (not illustrated) in a clockwise direction in FIG. 1. A laser scanner 35 emits a laser beam based on image data. The laser scanner 35 corresponding to the image forming unit 28 emits a laser beam corresponding to yellow image data. The photosensitive drum is scanned by the laser beam emitted from the laser scanner 35. Accordingly, an electrostatic latent image corresponding to the yellow image data is formed on the photosensitive drum.

The image forming unit 28 includes a developing device storing the yellow toner and a transfer roller 39Y. The developing device develops the electrostatic latent image on the photosensitive drum using the yellow toner and forms a yellow toner image. The transfer roller 39Y transfers the yellow toner image on the photosensitive drum to the intermediate transfer belt 27B. The image forming units 29, 30, and 31 have the same configurations as the image forming unit 28 except that colors of toners stored in the respective developing devices are different. Thus, the configurations of the image forming units 29, 30, and 31 are omitted from the description.

The image forming units 28, 29, 30, and 31 respectively transfer images to the intermediate transfer belt 27B so as to overlap with each other, and a full color toner image is born on the intermediate transfer belt 27B. The toner image born on the intermediate transfer belt 27B is conveyed by the intermediate transfer belt 27B to a transfer nip portion between the driving roller 27D and a transfer roller 26.

The sheet feeding cassette 21 stores sheets P. The sheets P in the sheet feeding cassette 21 are fed one by one by a pickup roller 22, a roller 23, and a roller 24. The fed sheet P is conveyed by a roller pair 60 to a registration roller pair 25. The registration roller pair 25 controls a conveyance timing and a conveyance speed of the sheet P so that a timing when the toner image on the intermediate transfer belt 27B reaches the transfer nip portion and a timing when the sheet P reaches the transfer nip portion become the same.

During when the toner image on the intermediate transfer belt 27B and the sheet P pass through the transfer nip portion, a transfer voltage is applied from a power source unit (not illustrated) to the transfer roller 26. Accordingly, the toner image on the intermediate transfer belt 27B is transferred to the sheet P.

Figure 2:
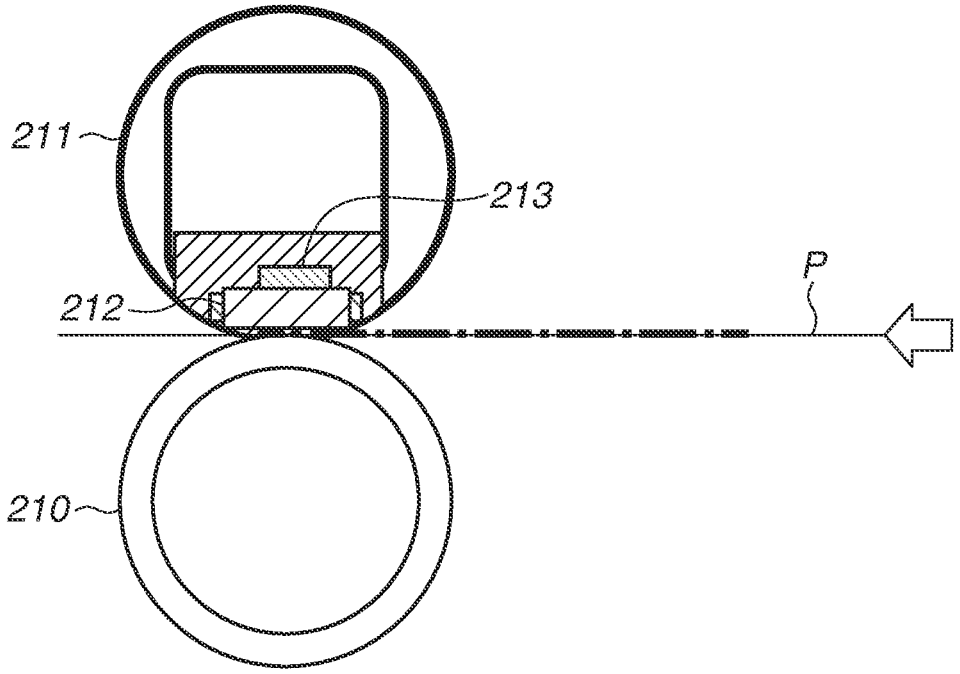
FIG. 2 is a schematic cross-sectional view of a fixing unit.

The sheet P on which the toner image is transferred is conveyed to the fixing unit 200. FIG. 2 is a cross-sectional view of a main section of the fixing unit 200. The fixing unit 200 includes a fixing belt 211, a pressing roller 210, a heating member 212, and a thermistor 213 for detecting a temperature of the heating member 212. The fixing unit 200 heats and presses the toner image on the sheet P to fix the toner image to the sheet P. The sheet P on which the toner image is fixed by the fixing unit 200 is discharged by a roller pair 38 and a discharge roller pair 34 to a sheet discharge tray 32.

(Description of Fixing Unit)

Figure 3A:
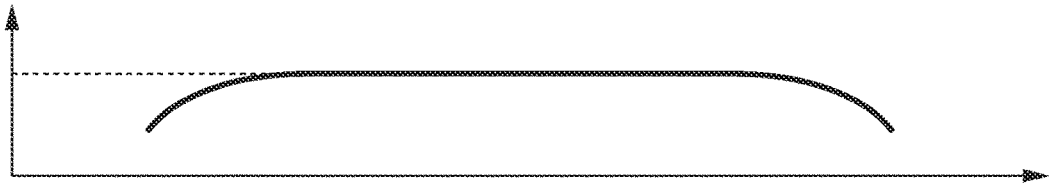
FIGS. 3A and 3B illustrate heat generation distribution of a heater A and a heater B.
Figure 3B:
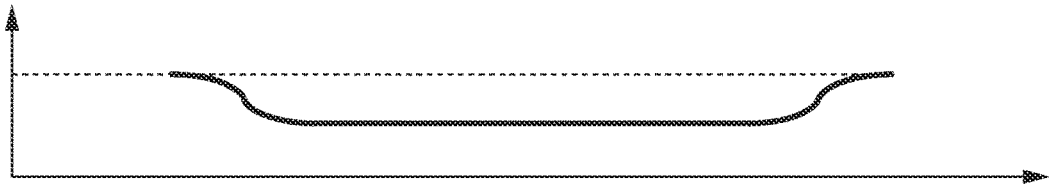

Next, the fixing unit 200 is described. The heating member 212 is a ceramic heater and includes a first heater 212A and a second heater 212B which are printed on a ceramic substrate. FIG. 3A illustrates a heat gradient of the first heater 212A in a direction perpendicular to a conveyance direction of the sheet P. FIG. 3B illustrates a heat gradient of the second heater 212B in the direction perpendicular to the conveyance direction of the sheet P. The heat gradient is a ratio of a heating value of the heater with respect to supplied power.

As illustrated in FIGS. 3A and 3B, the heat gradients of the first heater 212A and the second heater 212B are different in a longitudinal direction. The heat gradient of first heater 212A is the maximum near the center of the longitudinal direction, and the heat gradients at both end portions in the longitudinal direction are lower than the center. On the other hand, the heat gradient of the second heater 212B is the maximum at the both end portions in the longitudinal direction, and the heat gradient near the center of the longitudinal direction is lower than the heat gradients at the both end portions. The power supply to the two heaters having different heat gradients is controlled so as to make temperature distribution of the heating member 212 uniform in the direction perpendicular to the conveyance direction of the sheet P.

The thermistor 213 is installed in the heating member 212 and detects the temperature of the heating member 212. Information about the temperature of the heating member 212 detected by the thermistor 213 is output to the control unit 100. The control unit 100 obtains the information about the temperature of the heating member 212 detected by the thermistor 213 and controls amounts of electric power supplied to the first heater 212A and the second heater 212B so that the temperature of the heating member is maintained at the target temperature.

(Power Control of Heating Member)

Figure 4:
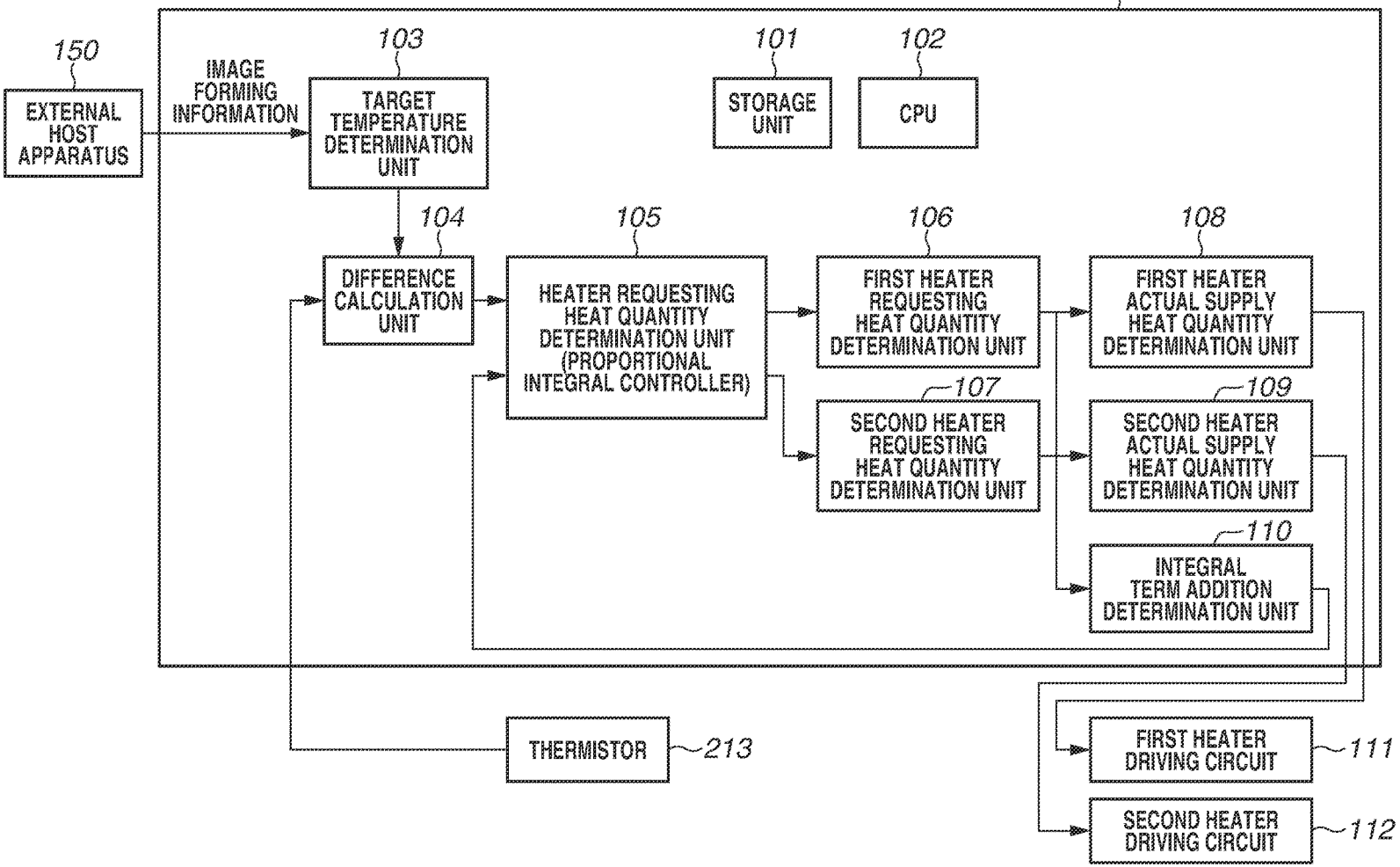
FIG. 4 is a control block diagram regarding power control of a heating member.
Figure 5:
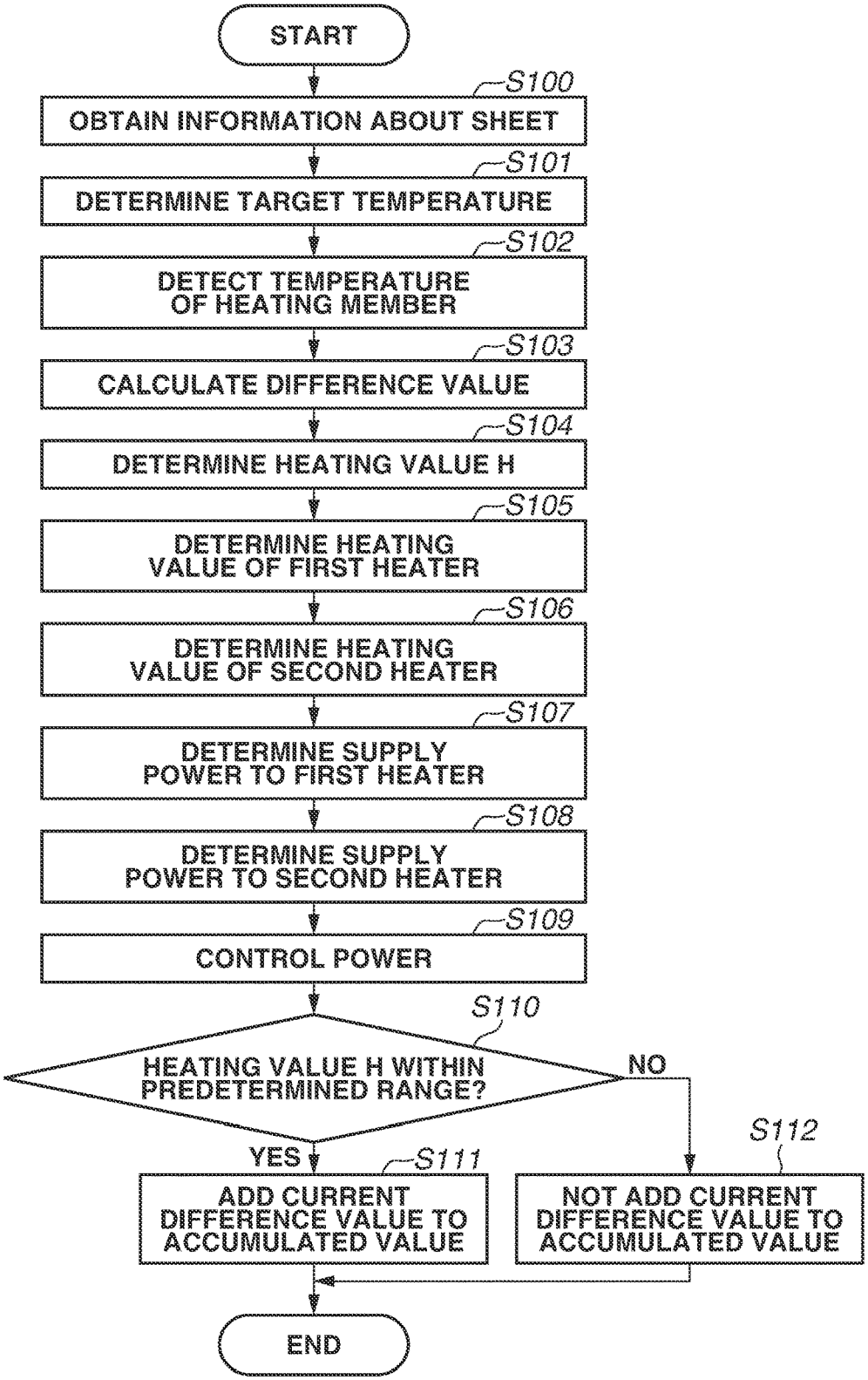
FIG. 5 is a flowchart illustrating power control.

Power control of the heating member is described below with reference to a function block diagram of the control unit 100 (FIG. 4) and a flowchart (FIG. 5).

A central processing unit (CPU) 102 is a control circuit for controlling each unit to execute the power control of the heating member 212. A storage unit 101 stores a control program necessary for executing various types of processing in the flowchart described below executed by the CPU 102. The external host apparatus 150 is described above with reference to FIG. 1, and thus the description thereof is omitted here. The thermistor 213 is described above with reference to FIG. 2, and thus the description thereof is omitted here.

The control unit 100 determines power to be supplied to the first heater 212A and power to be supplied to the second heater 212B based on the information about the temperature of the heating member 212 detected by the thermistor 213. A first heater driving circuit 111 supplies the power to the first heater 212A based on the power to be supplied to the first heater 212A. A second heater driving circuit 112 supplies the power to the second heater 212B based on the power to be supplied to the second heater 212B. In other words, the control unit 100 controls the first heater driving circuit 111 and the second heater driving circuit 112 to control the power to be supplied to the first heater 212A and the second heater 212B.

The control unit 100 starts the power control of the heating member 212 in response to transfer of image data from the external host apparatus 150. After starting the power supply to the heating member 212, the control unit 100 determines the power to be supplied to the heating member 212 for, for example, every 0.2 seconds.

In step S100, the CPU 102 analyzes the image data transferred from the external host apparatus 150 and obtains information about a sheet on which the image is formed. In step S100, the information about a sheet on which the image is formed is, for example, a basis weight and a type of the sheet, and the like.

Subsequently, in step S101, a target temperature determination unit 103 determines the target temperature of the heating member 212 based on the information about the sheet. In step S101, the target temperature determination unit 103 determines a target temperature Tref based on data indicating a correspondence relationship between the information about the sheet and the target temperature. The data indicating the correspondence relationship between the information about the sheet and the target temperature is stored in the storage unit 101 in advance.

Subsequently, in step S102, the control unit 100 detects the temperature of the heating member 212 by the thermistor 213. In step S103, a difference calculation unit 104 determines a difference value ΔT based on a detected result of the thermistor 213. In step S103, the difference calculation unit 104 calculates the difference value ΔT between the target temperature Tref determined by the target temperature determination unit 103 in step S101 and a detected temperature T detected by the thermistor 213 in step S102 based on an equation (1).

$$\Delta T(n)=T(n)-\mathrm{Tref}(n) \tag{1}$$

"n" represents a control timing. A timing for determining the power to be supplied to the heating member 212 corresponds to the control timing. The control unit 100 determines the power to be supplied to the heating member 212 for every 0.2 seconds (the control timing), however, the control timing may be appropriately determined.

In step S104, a heater requesting heat quantity determination unit 105 determines a heating value H of the heating member 212 based on the difference value ΔT(n) calculated at the control timing n and an accumulated value ΣΔT(n) of the temperature differences calculated for every control timing. The accumulated value ΣΔT(n) is a value calculated based on a temperature detected by the thermistor 213 for every 0.2 seconds (the control timing) and the target temperature after power is supplied to the heating member 212. The accumulated value ΣΔT(n) is determined in step S111 or S112 described below. The heater requesting heat quantity determination unit 105 determines the heating value based on, for example, an equation (2).

$$\text{Heating value } H=\alpha*\Delta T(n)+\beta*\Sigma\Delta T(n) \quad (2)$$

Constants α and β are gains determined in advance by an experiment. The constants α and β are, for example, positive values less than one.

Subsequently, in step S105, a first heater requesting heat quantity determination unit 106 determines a heating value of the first heater 212A based on the heating value H determined in step S104. The first heater requesting heat quantity determination unit 106 determines the heating value of the first heater 212A (a first heating value) by multiplying the heating value H by a coefficient K1 determined in advance. Further, in step S106, a second heater requesting heat quantity determination unit 107 determines a heating value of the second heater 212B based on the heating value H determined in step S104. The second heater requesting heat quantity determination unit 107 determines the heating value of the second heater 212B (a second heating value) by multiplying the heating value H by a coefficient K2 determined in advance. The coefficients K1 and K2 are determined in advance so that a sum total of the first heating value and the second heating value becomes the heating value H.

Subsequently, in step S107, a first heater actual supply heat quantity determination unit 108 determines a first supply power corresponding to the first heater 212A based on the first heating value determined in step S105 and maximum power which can be supplied to the first heater 212A. In step S107, the first heater actual supply heat quantity determination unit 108 determines the power corresponding to the first heating value using data indicating a correspondence relationship between the first heating value and the power to be supplied to the first heater 212A. Further, the first heater actual supply heat quantity determination unit 108 sets the power corresponding to the first heating value to the first supply power when the power corresponding to the first heating value is less than or equal to the maximum power which can be supplied to the first heater 212A.

On the other hand, in step S107, when the power corresponding to the first heating value is greater than the maximum power which can be supplied to the first heater 212A, the first heater actual supply heat quantity determination unit 108 sets the maximum power which can be supplied to the first heater 212A to the first supply power. The maximum power which can be supplied to the heating member 212 is determined by the control unit 100 based on the power supplied from a commercial power source. The first heater actual supply heat quantity determination unit 108 functions as a restriction unit for restricting the power which can be supplied to the first heater 212A to less than or equal to the maximum power (an upper limit value).

In step S108, a second heater actual supply heat quantity determination unit 109 determines a second supply power corresponding to the second heater 212B based on the second heating value determined in step S106 and maximum power which can be supplied to the second heater 212B. In step S108, the second heater actual supply heat quantity determination unit 109 determines the power corresponding to the second heating value using data indicating a correspondence relationship between the second heating value and the power to be supplied to the second heater 212B. Further, the second heater actual supply heat quantity determination unit 109 sets the power corresponding to the second heating value to the second supply power when the power corresponding to the second heating value is less than or equal to the maximum power which can be supplied to the second heater 212B.

On the other hand, in step S108, when the power corresponding to the second heating value is greater than the maximum power which can be supplied to the second heater 212B, the second heater actual supply heat quantity determination unit 109 sets the maximum power which can be supplied to the second heater 212B to the second supply power. The second heater actual supply heat quantity determination unit 109 functions as a restriction unit for restricting the power which can be supplied to the second heater 212B to less than or equal to the maximum power (an upper limit value).

Subsequently, in step S109, the control unit 100 controls the power to be supplied to the first heater 212A and the second heater 212B. In step S109, the control unit 100 controls the first heater driving circuit 111 to supply the power to the first heater 212A based on the first supply power and controls the second heater driving circuit 112 to supply the power to the second heater 212B based on the second supply power.

When voltage drop occurs and causes reduction of power supplied from the commercial power source to the image forming apparatus, the control unit 100 reduces the maximum power which can be supplied to the heating member 212. When the power supplied to the heating member 212 is restricted, there is a possibility that a difference between the target temperature and the temperature detected by the thermistor 213 is increased. In this case, the accumulated value of the difference between the target temperature and the detected temperature is increased, and the heating value H of the heating member 212 is excessively increased. Accordingly, there is a possibility that the temperature of the heating member 212 causes an overshoot with respect to the target temperature.

Thus, in step S110, an integral term addition determination unit 110 determines whether the heating value H is within a predetermined range and, when the heating value H is not within the predetermined range, determines that the heating value H calculated by the heater requesting heat quantity determination unit 105 is different from an actual heating value of the heating member 212.

In step S110, when the integral term addition determination unit 110 determines that the heating value is within the predetermined range (YES in step S110), in step S111, the heater requesting heat quantity determination unit 105 adds the difference value ΔT(n) to the accumulated value ΣΔT(n). Accordingly, when a heating value H(n) determined at the current control timing n is within the predetermined range, the heater requesting heat quantity determination unit 105 determines a heating value H(n+1) based on a difference value ΔT(n+1) and an accumulated value ΣΔT(n+1) at the next control timing. The heating value H(n), the difference value ΔT(n), and the accumulated value ΣΔT(n) respectively correspond to a first control value, a first difference value, and a first accumulated value.

On the other hand, in step S110, when the integral term addition determination unit 110 determines that the heating value is not within the predetermined range (NO in step S110), in step S112, the heater requesting heat quantity determination unit 105 maintains the accumulated value ΣΔT(n) without adding the difference value ΔT(n) to the accumulated value ΣΔT(n). Accordingly, when the heating value H(n) determined at the current control timing n is not within the predetermined range, the heater requesting heat quantity determination unit 105 determines the heating value H(n+1) based on the difference value ΔT(n+1) and the accumulated value ΣΔT(n) at the next control timing. The heater requesting heat quantity determination unit 105 may be configured not to add the difference value ΔT(n) to the accumulated value ΣΔT(n) when it is determined that the heating value H is not within the predetermined range in step S110. The heater requesting heat quantity determination unit 105 may be configured to add, for example, an extremely small value to the accumulated value ΣΔT(n). Alternatively, the heater requesting heat quantity determination unit 105 may be configured to add, for example, zero to the accumulated value ΣΔT(n). The heating value H(n+1), the difference value ΔT(n+1), and the accumulated value ΣΔT(n+1) respectively correspond to a second control value, a second difference value, and a second accumulated value.

In step S112, the heater requesting heat quantity determination unit 105 does not execute accumulation processing of differences, so that the accumulated value can be suppressed from being excessively increased even when the maximum power which can be supplied to the heating member 212 is reduced. Accordingly, the heating value H can be suppressed from being excessively increased even though the temperature of the heating member 212 has reached the target temperature.

In addition, embodiments of the present invention are also effective to a case in which the difference value ΔT(n) becomes a negative value because the target temperature is changed during when a plurality of images is fixed on the sheet P, and the target temperature becomes lower than the detected temperature. Since the control unit 100 calculates the heating value H for every predetermined time, there is a possibility that the heating value H calculated in a state in which the target temperature is lower than the detected temperature becomes a negative value. Accordingly, there is a possibility that the accumulated value suppresses an increase of the heating value H even though the temperature of the heating member 212 is lowered to the target temperature, and the temperature of the heating member 212 causes an undershoot with respect to the target temperature.

However, when a lower limit value of the predetermined range is, for example, zero, the heater requesting heat quantity determination unit 105 does not add the difference value to the accumulated value, and thus a possibility that the temperature of the heating member 212 causes the undershoot with respect to the target temperature can be suppressed.

The description is returned to that of the flowchart. After the integral term addition determination unit 110 completes determination processing, the control unit 100 terminates the power control executed at the current control timing n.

Description of Effect

Figure 6A:
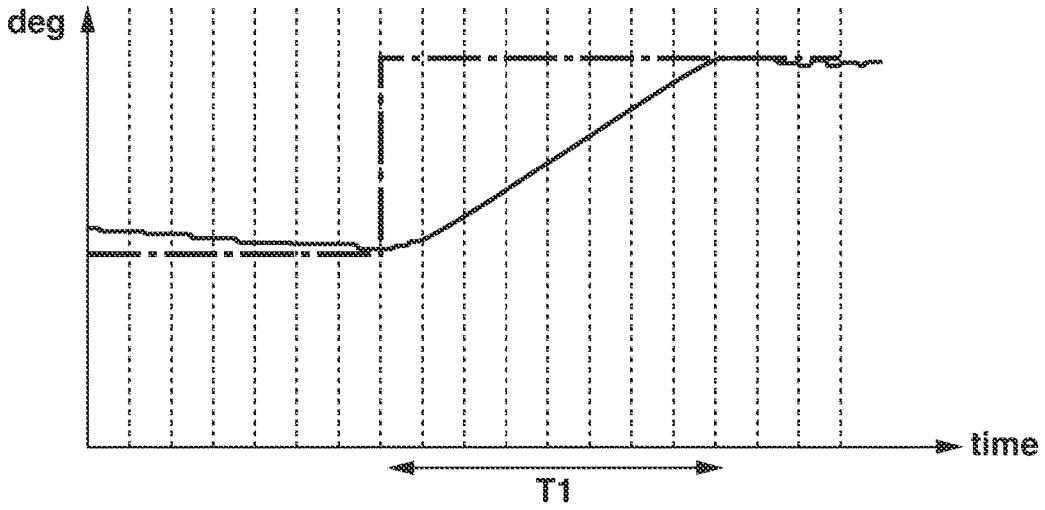
FIGS. 6A and 6B illustrate transition of heater temperature when power is restricted.
Figure 6B:
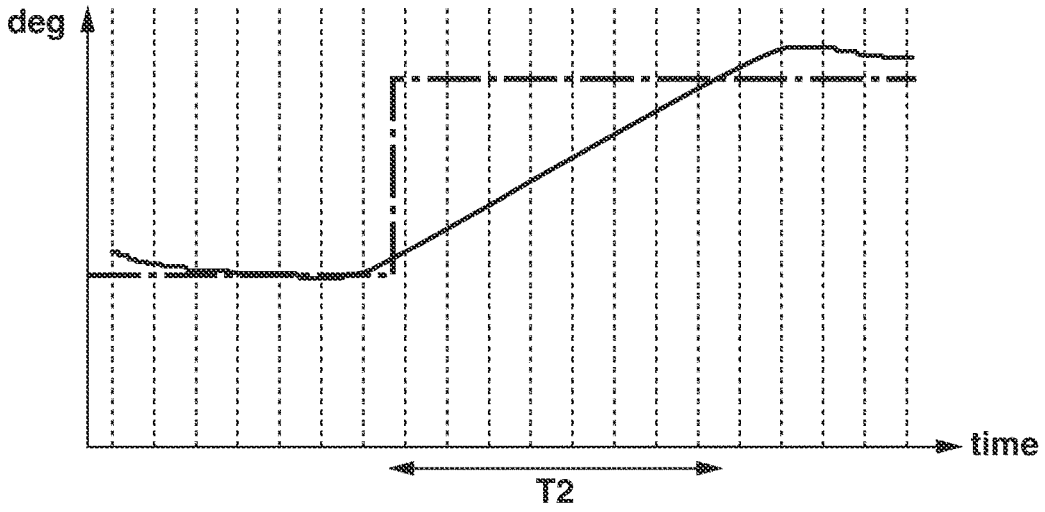

FIGS. 6A and 6B illustrate effects of newly adding zero to the integral term when a requested heating value determined by the heater requesting heat quantity determination unit 105 exceeds an actuator capacity of the actual heating member 212.

FIGS. 6A and 6B illustrate transition of temperature and the heating value when power restriction is executed. In FIGS. 6A and 6B, the abscissa is time, and the ordinate is the temperature of the heating member 212. Solid lines in FIGS. 6A and 6B indicate actual temperatures of the heating member 212, and dashed lines indicate the target temperatures.

FIG. 6A is a transition diagram of temperature when addition to the accumulated value (integral term) is zero during when the power supplied to the heating member 212 is restricted. FIG. 6B is a transition diagram of temperature when the accumulated value (integral term) is continuously added during when the power supplied to the heating member 212 is restricted. In FIG. 6A, the power is restricted in a term T1, and in FIG. 6B, the power is restricted in a term T2.

In FIG. 6B, the temperature of the heating member 212 is continuously raised more than that in FIG. 6A after the temperature of the heating member 212 exceeding the target temperature. This is because that the accumulated value (integral term) is increased, and the power supplied to the heating member 212 cannot be appropriately reduced, even though the temperature of the heating member 212 has reached the target temperature.

In the above description, an embodiment is configured not to add the difference value to the accumulated value when the heating value H is not within the predetermined range, however, the similar effect can be obtained when an embodiment is configured not to add the difference value to the accumulated value when the power to be supplied to the heating member 212 is not within a predetermined range.

According to an embodiment of the present invention, addition to the accumulated value is prohibited when the power is restricted, and the requested heating value and the actual heating value of the heating member 212 are deviated from each other, so that the temperature of the heating member 212 promptly converges on the target temperature without causing an overshoot as in the case of FIG. 6B. Further, when the target temperature is changed, and the requested heating value of the heating member 212 becomes a negative value, addition to the accumulated value is prohibited. Accordingly, the temperature of the heating member 212 promptly converges on the target temperature without causing an undershoot. In other words, power to be supplied to that heater can be controlled with high accuracy even when a difference between the target temperature and the heater temperature is increased.

Modification

Figure 7:
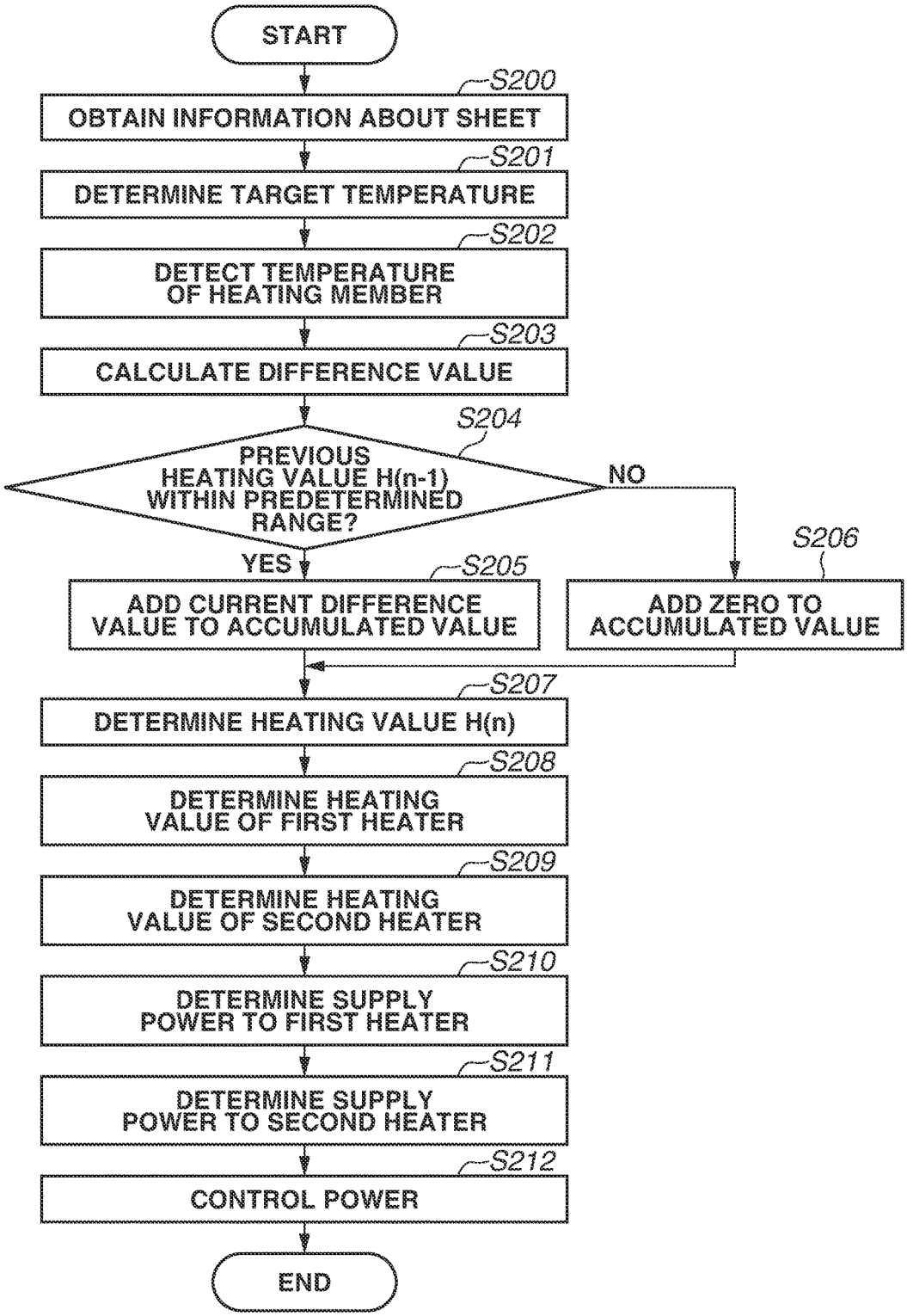
FIG. 7 is another flowchart illustrating power control.

Next, a modification is described with reference to a flowchart in FIG. 7.

In step S200, the CPU 102 analyzes image data transferred from the external host apparatus 150 and obtains information about a sheet on which the image is formed. In step S201, the target temperature determination unit 103 determines the target temperature of the heating member 212 based on the information about the sheet. In step S201, the target temperature determination unit 103 determines the target temperature Tref based on data indicating the correspondence relationship between the information about the sheet and the target temperature.

Subsequently, in step S202, the control unit 100 detects the temperature of the heating member 212 by the thermistor 213. In step S203, the difference calculation unit 104 determines the difference value ΔT based on the detected result of the thermistor 213. In step S203, the difference calculation unit 104 calculates the difference value ΔT between the target temperature Tref determined by the target temperature determination unit 103 in step S201 and the detected temperature T detected by the thermistor 213 in step S202 based on the equation (1).

Subsequently, in step S204, the integral term addition determination unit 110 determines whether a heating value H(n−1) previously calculated is within the predetermined range. When the previous heating value H(n−1) is not within the predetermined range, the control unit 100 determines that the previous heating value H(n−1) is different from an actual value of the previous heating value of the heating member 212.

In step S204, when the integral term addition determination unit 110 determines that the previous heating value H(n−1) is within the predetermined range (YES in step S204), in step S205, the heater requesting heat quantity determination unit 105 adds the current difference value ΔT(n) to the previous accumulated value ΣΔT(n−1). Accordingly, the heater requesting heat quantity determination unit 105 determines the heating value H(n) based on the difference value ΔT(n) and the accumulated value ΣΔT(n) at the current control timing n. The previous heating value H(n−1) corresponds to a value regarding the power supplied to the heating member.

On the other hand, in step S204, when the integral term addition determination unit 110 determines that the previous heating value H(n−1) is not within the predetermined range (NO in step S204), in step S206, the heater requesting heat quantity determination unit 105 adds zero to the previous accumulated value ΣΔT(n−1) so as to determine the accumulated value ΣΔT(n). The heater requesting heat quantity determination unit 105 may be configured not to add the difference value ΔT(n) to the previous accumulated value ΣΔT(n−1) in step S206. The heater requesting heat quantity determination unit 105 may be configured to add, for example, an extremely small value to the previous accumulated value ΣΔT(n−1).

Subsequently, in step S207, the heater requesting heat quantity determination unit 105 determines the heating value H of the heating member 212 based on the difference value ΔT(n) calculated at the control timing n and the accumulated value ΣΔT(n) determined in in step S205 or S206. In step S207, the heater requesting heat quantity determination unit 105 determines the heating value H(n) based on, for example, the equation (2).

Accordingly, when the previous heating value H(n−1) is not within the predetermined range, the heater requesting heat quantity determination unit 105 determines the heating value H(n) based on the difference value ΔT(n) and the accumulated value ΣΔT(n−1) at the current control timing n. In other words, even when the maximum power which can be supplied to the heating member 212 is reduced, the accumulated value can be suppressed from being excessively increased. Accordingly, the heating value H can be suppressed from being excessively increased even though the temperature of the heating member 212 has reached the target temperature. Further, even when the heating value H calculated in a state in which the target temperature is lower than the detected temperature becomes a negative value, a possibility that the temperature of the heating member 212 causes the undershoot with respect to the target temperature can be suppressed.

Subsequently, in step S208, the first heater requesting heat quantity determination unit 106 determines the heating value of the first heater 212A based on the heating value H(n) determined in step S207. The first heater requesting heat quantity determination unit 106 determines the heating value of the first heater 212A (the first heating value) by multiplying the heating value H(n) by the coefficient K1 determined in advance. Further, in step S209, the second heater requesting heat quantity determination unit 107 determines the heating value of the second heater 212B based on the heating value H determined in step S207. The second heater requesting heat quantity determination unit 107 determines the heating value of the second heater 212B (the second heating value) by multiplying the heating value H(n) by the coefficient K2 determined in advance. The coefficients K1 and K2 are determined in advance so that a sum total of the first heating value and the second heating value becomes the heating value H(n).

Subsequently, in step S210, the first heater actual supply heat quantity determination unit 108 determines the first supply power corresponding to the first heater 212A based on the first heating value determined in step S208 and the maximum power which can be supplied to the first heater 212A. In step S210, the first heater actual supply heat quantity determination unit 108 determines the power corresponding to the first heating value using the data indicating the correspondence relationship between the first heating value and the power to be supplied to the first heater 212A. Further, the first heater actual supply heat quantity determination unit 108 sets the power corresponding to the first heating value to the first supply power when the power corresponding to the first heating value is less than or equal to the maximum power which can be supplied to the first heater 212A.

On the other hand, in step S210, when the power corresponding to the first heating value is greater than the maximum power which can be supplied to the first heater 212A, the first heater actual supply heat quantity determination unit 108 sets the maximum power which can be supplied to the first heater 212A to the first supply power. The maximum power which can be supplied to the heating member 212 is determined by the control unit 100 based on the power supplied from the commercial power source. The first heater actual supply heat quantity determination unit 108 functions as the restriction unit for restricting the power which can be supplied to the first heater 212A to less than or equal to the maximum power (the upper limit value).

In step S211, the second heater actual supply heat quantity determination unit 109 determines the second supply power corresponding to the second heater 212B based on the second heating value determined in step S209 and the maximum power which can be supplied to the second heater 212B. In step S211, the second heater actual supply heat quantity determination unit 109 determines the power corresponding to the second heating value using data indicating the correspondence relationship between the second heating value and the power to be supplied to the second heater 212B. Further, the second heater actual supply heat quantity determination unit 109 sets the power corresponding to the second heating value to the second supply power when the power corresponding to the second heating value is less than or equal to the maximum power which can be supplied to the second heater 212B.

On the other hand, in step S211, when the power corresponding to the second heating value is greater than the maximum power which can be supplied to the second heater 212B, the second heater actual supply heat quantity determination unit 109 sets the maximum power which can be supplied to the second heater 212B to the second supply power. The second heater actual supply heat quantity determination unit 109 functions as the restriction unit for restricting the power which can be supplied to the second heater 212B to less than or equal to the maximum power (the upper limit value).

Subsequently, in step S212, the control unit 100 controls the power to be supplied to the first heater 212A and the second heater 212B. In step S212, the control unit 100 controls the first heater driving circuit 111 to supply the power to the first heater 212A based on the first supply power and controls the second heater driving circuit 112 to supply the power to the second heater 212B based on the second supply power. Subsequently, the control unit 100 terminates the power control executed at the current control timing n.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-176855, filed Sep. 8, 2015, which is hereby incorporated by reference herein in its entirety.

What is claimed is:

1. An image forming apparatus comprising:

an image forming unit configured to form an image on a sheet;

a fixing unit having a heating member for generating heat based on power supplied, and configured to fix the image on the sheet by the heat of the heating member;

a detection unit configured to detect a temperature of the heating member; and a controller configured to:

determine a difference value between the detected temperature and a target temperature, determine an accumulated value by accumulating the difference value, determine a calculated value based on the difference value and the accumulated value, control power to be supplied to the heating member based on the calculated value, wherein, in a case where the calculated value is less than a predetermined value, the controller controls power to be supplied to the heating member next time based on the difference value and an alternate value that is different from the accumulated value, and wherein the alternate value is a previous accumulated value.

2. The image forming apparatus according to claim 1, wherein the predetermined value is zero.

3. The image forming apparatus according to claim 1, wherein the controller further is configured to obtain information related to the sheet and to determine the target temperature based on the information.

4. The image forming apparatus according to claim 3, wherein the information includes a basis weight of the sheet.

5. The image forming apparatus according to claim 3, wherein the information includes a type of the sheet.

6. The image forming apparatus according to claim 1, wherein the heating member includes a first heater and a second heater.

7. The image forming apparatus according to claim 6, wherein the controller further is configured to determine a first heating value of the first heater based on the difference value and the accumulated value and determines a second heating value of the second heater based on the difference value and the accumulated value, wherein, in a case where the first heating value is determined, the controller determines first power to be supplied to the first heater based on the first heating value, and wherein, in a case where the second heating value is determined, the controller determines second power to be supplied to the second heater based on the second heating value.

8. The image forming apparatus according to claim 7, wherein the controller controls the first power in a case where the first power is greater than first upper limit power corresponding to the first heater, and wherein the controller controls the second power in a case where the second power is greater than second upper limit power corresponding to the second heater.

9. An image forming apparatus comprising:

an image forming unit configured to form an image on a sheet;

a fixing unit having a heating member for generating heat based on power supplied, and configured to fix the image on the sheet by the heat of the heating member;

a detection unit configured to detect a temperature of the heating member; and a controller configured to:

determine a difference value between the detected temperature and a target temperature, determine an accumulated value by accumulating the difference value, and control power to be supplied to the heating member based on the difference value and the accumulated value, wherein the controller controls whether to add a current difference value to a previous accumulated value based on a previous difference value and the previous accumulated value.

10. The image forming apparatus according to claim 9, wherein, in a case where the controller does not add the current difference value to the previous accumulated value, the controller determines the previous accumulated value as the accumulated value.

11. The image forming apparatus according to claim 9, wherein, in a case where the controller does not add the current difference value to the previous accumulated value, the controller adds a predetermined value, instead of the current difference value, to the previous accumulated value.

12. The image forming apparatus according to claim 11, wherein the predetermined value is zero.

13. The image forming apparatus according to claim 9, wherein, in a case where the detected temperature of the heating member is lower than the target temperature, the controller does not add the current difference value to the previous accumulated value.

14. The image forming apparatus according to claim 9, wherein the controller further is configured to determine a heating value based on the difference value and the accumulated value, and wherein the controller does not add the current difference value to the previous accumulated value in a case where the heating value is out of a predetermined range.

* * * * *